US005158151A

United States Patent [19]

Chang

[11] Patent Number: 5,158,151

[45] Date of Patent: Oct. 27, 1992

[54] BIDIRECTIONALLY FOLDABLE STEP LADDER

[76] Inventor: Wan-Li Chang, No. 66, Lane 142, Sec. 1, Yung An Nan Rd., Taipei Hsien, Taiwan

[21] Appl. No.: 822,862

[22] Filed: Jan. 21, 1992

[51] Int. Cl.[5] ..... E06C 1/00

[52] U.S. Cl. ..... 182/159; 182/156

[58] Field of Search ..... 182/156, 159, 160, 157, 182/152

[56] References Cited

U.S. PATENT DOCUMENTS

| | | | |
|---|---|---|---|
| 958,732 | 5/1910 | Dennis | 182/160 |
| 1,054,108 | 2/1913 | Garraway | 182/160 |
| 1,371,125 | 3/1921 | Speckman, Jr. | 182/160 |
| 3,084,760 | 4/1963 | Lamberti | 182/160 |
| 4,560,030 | 12/1985 | Mucelli | 182/160 X |
| 4,842,099 | 6/1989 | Collet et al. | 182/160 |

*Primary Examiner*—Blair M. Johnson

*Attorney, Agent, or Firm*—Peterson, Wicks, Nemer & Kamrath

[57] ABSTRACT

A step ladder which folds with respect to a width and a depth thereof. Two sets of unidirectionally foldable steps are pivotally attached between two pairs of side rails, and foldable spreaders are pivotally attached between opposing side rails. Each step has two halves, and a brace is pivotally attached to each half. A translation assembly is disposed in each side rail to which each brace is attached. A head step is disposed on a top of the ladder and is pivotal in the two directions of the step ladder. When the ladder is folded with respect to its width, the step fold upward, drawing the braces upward by means of the translation assembly. When the ladder is folded with respect to its depth, the spreaders are folded, resulting in a completely folded ladder with the steps and the braces substantially contained within the side rails. A locking assembly is disposed between the side rails for preventing the ladder from folding. A retaining assembly prevents the ladder from unfolding.

10 Claims, 8 Drawing Sheets

BIDIRECTIONALLY FOLDABLE STEP LADDER

BACKGROUND OF THE INVENTION

The present invention relates to a foldable step ladder and, more particularly, to a step ladder which folds in two directions.

The purpose of folding step ladders is to provide a ladder which is easy to store and transport. Conventional folding step ladders generally have a plurality of rigid steps positioned between two pairs of side rails. A foldable spreader is pivotally attached to opposing side rails so that the step ladder may be folded for more convenient storage and transportation.

Although these types of step ladders fold, for all practical purposes, in half with respect to their depth, they still occupy considerable storage space in terms of their width. This storage space is considerably valuable when considered as inventory and transportation space. Also, when transporting such conventional ladders, there are no means present which prevent the ladder from unfolding, which often hinders transportation, aggravating an individual user.

Therefore, there remains a long and unfulfilled need in the field of foldable step ladders for a step ladder which is foldable in two directions so as to minimize storage space therefor and which has means for retaining the ladder in a folded position so as to ease transportation thereof.

SUMMARY OF THE INVENTION

The present invention provides a step ladder which is foldable in two directions: a first direction which folds the step ladder with respect to depth and a second direction which folds the step ladder with respect to width, thereby resulting in a folded position which minimizes the amount storage space. The present invention employs means which retain the step ladder in the folded position and means which prevent the step ladder from being folded as a safety device.

The present invention has two opposing pairs of side rails with a pair of foldable spreaders pivotally attached therebetween. Two sets of steps in plurality are respectively pivotally attached in a spaced relationship between the pairs of side rails. Bracing means are pivotally attached to the steps to provide support thereto. Translation means are disposed in each side rail which allow the bracing means to move upward as the steps pivot.

The steps are made up of substantially identical halves, and the side rails are substantially identically U-shaped. Each bracing means is substantially identical. This symmetry of parts lowers the manufacturing cost of the ladder by reducing the number of molds and assembly time. Also, when in the folded position, the steps and the bracing means are substantially contained within the side rails, yielding in streamlined storage.

For a better understanding of the present invention, its objects and advantages, reference should be made to the following description matter and accompanying drawings.

DETAILED DESCRIPTION OF THE PREFERRED EMBODIMENTS

Figure 1:
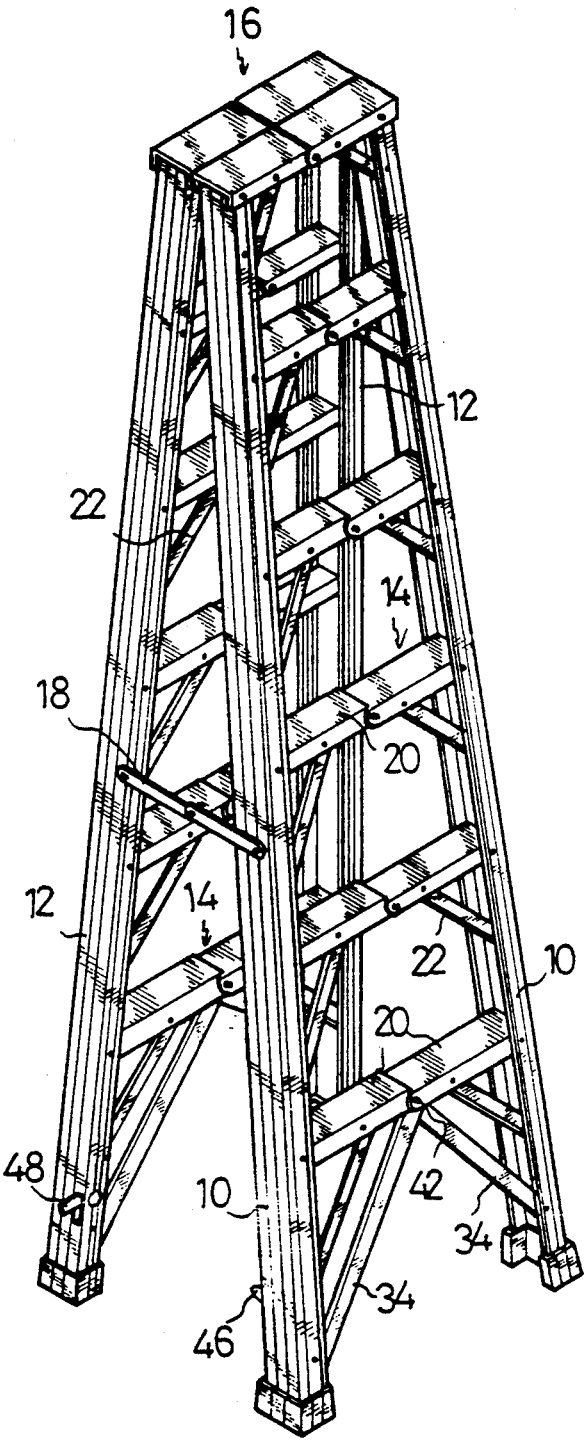
FIG. 1 is a perspective view of a bidirectionally foldable step ladder shown in a preferred embodiment in accordance with the present invention, illustrating an open position.

Referring to the drawings, particularly to FIG. 1, a bidirectionally foldable step ladder is shown in a preferred embodiment in accordance with the present invention and generally comprises four substantially identical side rails being divided into two opposing pairs of side rails, a first pair of side rails 10 and a second pair of side rails 12; two sets of substantially identical steps 14 in plurality, a first set and a second set of steps 14 being respectively disposed in spaced relationships between the first pair and the second pair of side rails 10 and 12; a head step 16 being disposed on tops of the side rails 10 and 12; and a pair of foldable spreaders 18 (only one can be seen) being respectively pivotally attached between opposing first and second side rails 10 and 12 by suitable means such as rivets, nuts and bolts, or the like.

Figure 2:
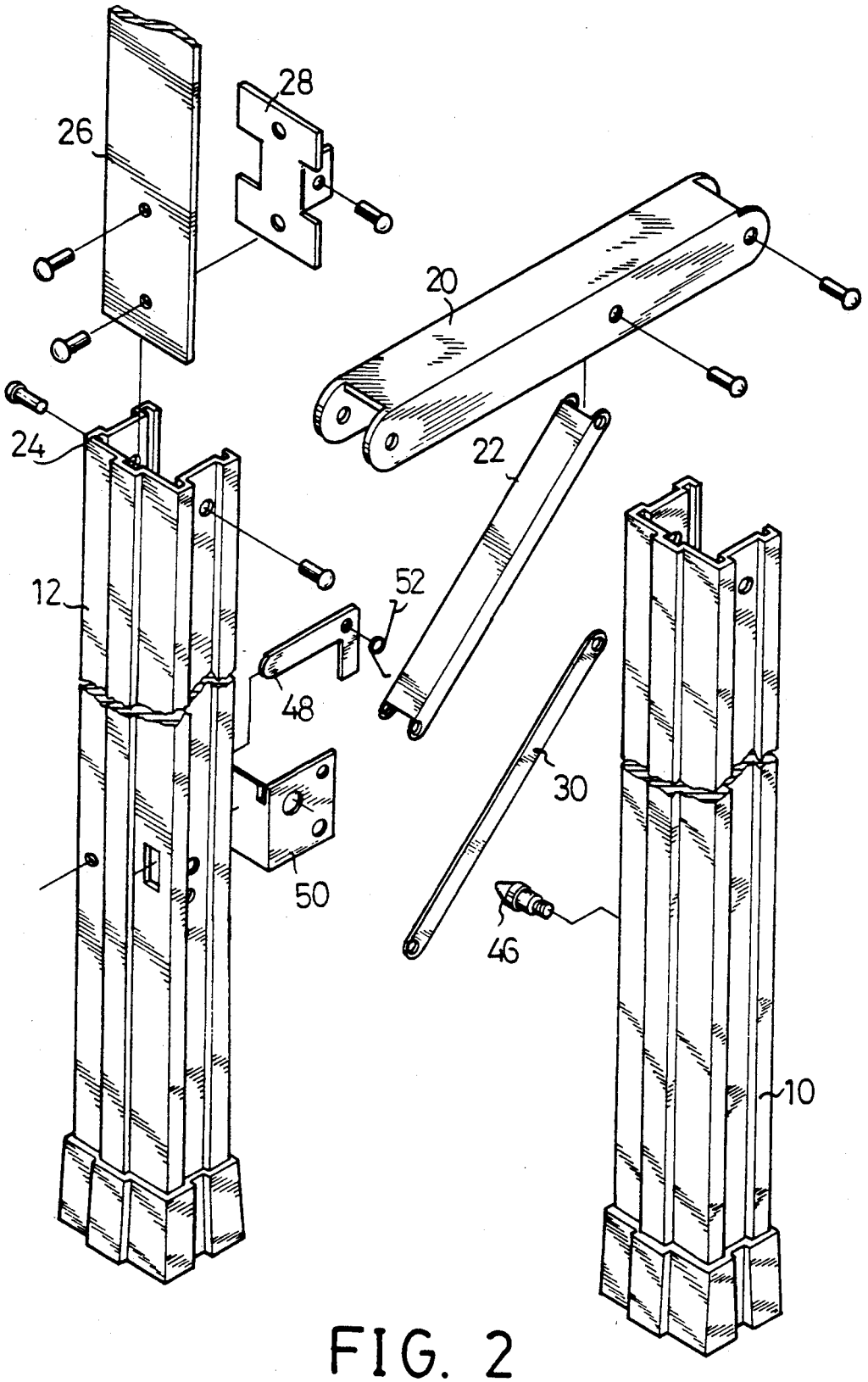
FIG. 2 is an exploded view of bracing means and retaining means of a bidirectionally foldable step ladder in accordance with the present invention.

Further referencing FIG. 2, each step comprises two substantially identical half steps 20 having an upper stepping surface and a pair of lower parallel rails. Each half step 20 is pivotally attached to a respective side rail 10 or 12 and to a corresponding half step 20 thereof by suitable means such as rivets as shown. For these pivotal attachments, the side rails 10 and 12 are substantially U-shaped so that the half steps 20 are receivable therein, and the lower rails of opposing half steps 20 are offset from each other, as best seen in FIG. 1.

With continued reference to FIGS. 1 and 2, bracing means 22 are pivotally attached by suitable means such as rivets to each half step 20 between lower rails thereof and to translation means each generally comprising a longitudinal slot 24 being formed in each side rail 10 and 12, a plate 26 being slidably received in the slot 24, and a bracket 28 being fixed to the plate 24 and to the bracing means 22. For the bracing means 22 to rigidly support the steps 14, the plate 26 is in a lowermost position such that further downward movement thereof is prevented which prevents the steps 14 from pivoting below the horizontal positions thereof shown in FIG. 1.

Figure 3:
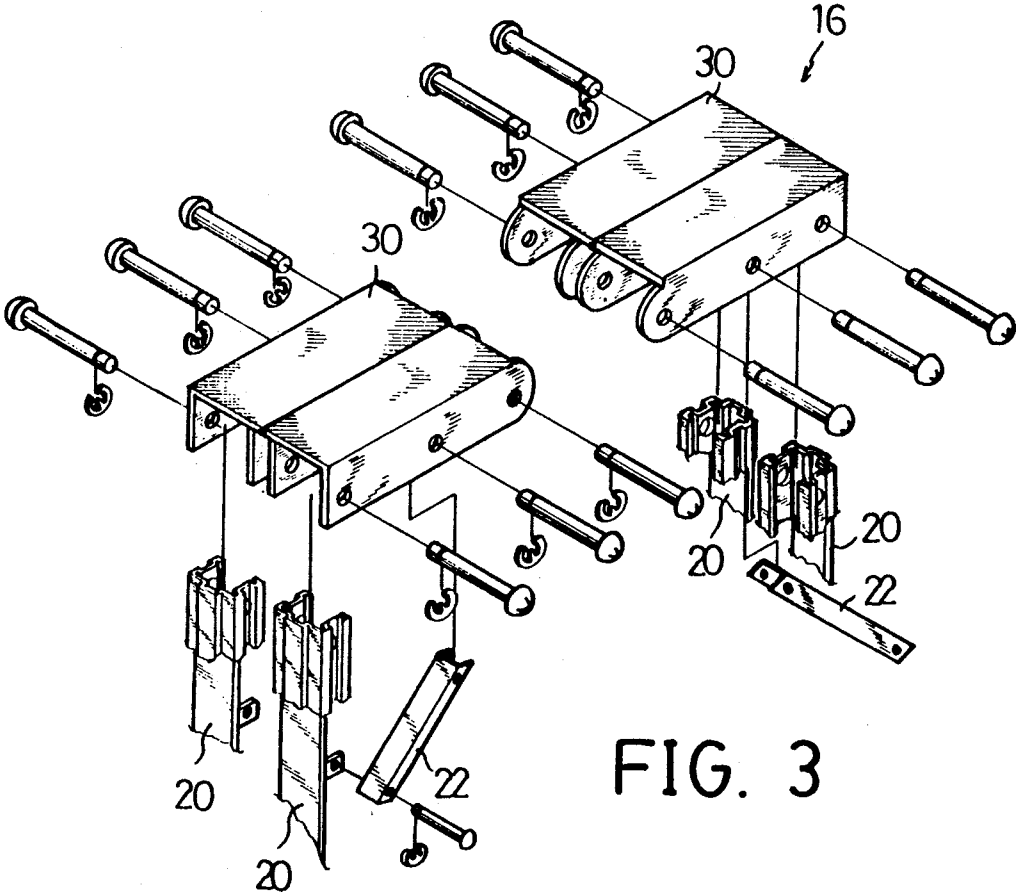
FIG. 3 is an exploded view of a head step of a bidirectionally foldable step ladder in accordance with the present invention.

Referring to FIG. 3, the head step 16 generally comprises four substantially identical quarter steps 30 each having an upper stepping surface and a pair of lower parallel rails and being divided into a first set and a second set of opposing quarter steps 30 being respectively pivotally attached over the tops of the first rails 10 and the second rails 12 by suitable means such as pins and clips as shown. Each quarter step 30 is pivotally attached to the opposing quarter step 30 thereof at the lower rails thereof by suitable means such as pins and clips. The first set and the second set of quarter steps 30 are pivotally attached to each other along top edges of common stepping surfaces thereof by suitable means such as hinges. Also, a bracing means 22 is disposed with each quarter step 30 in a like manner as described above.

Figure 4:
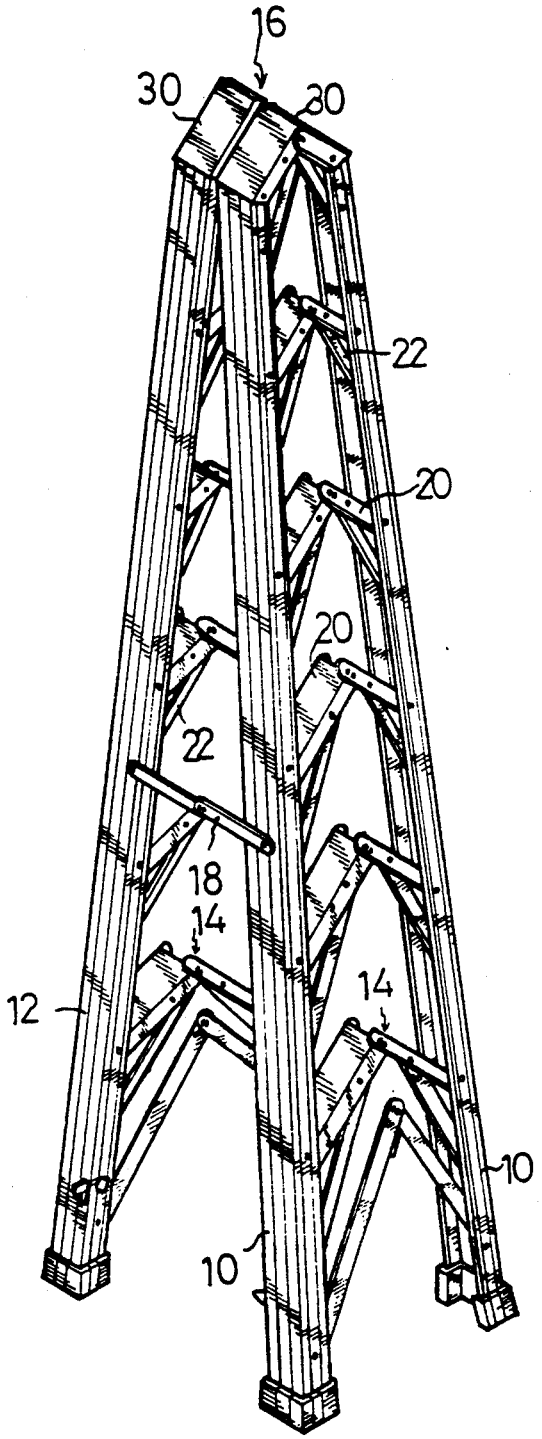
FIG. 4 is a view similar to FIG. 1, illustrating a semi-folded position.
Figure 5:
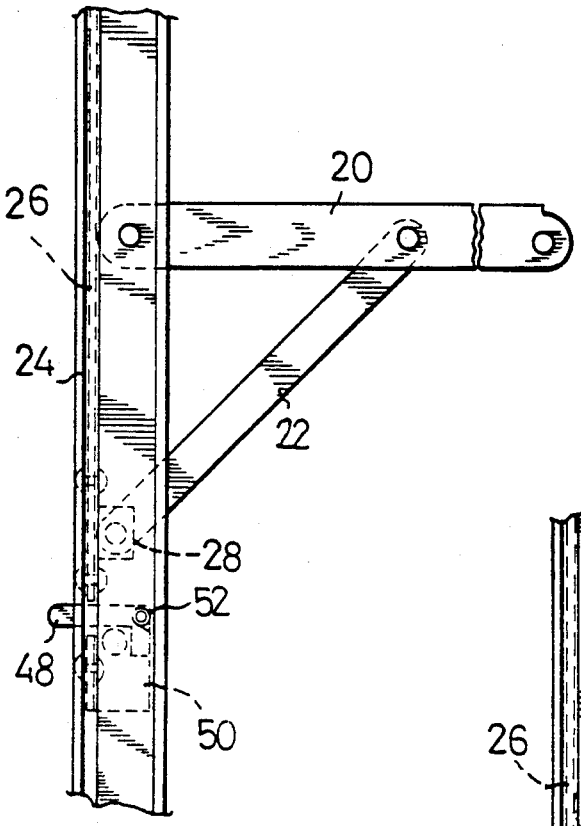
FIG. 5 is side plan view of the bracing means and the retaining means of FIG. 2, shown in the open position.
Figure 6:
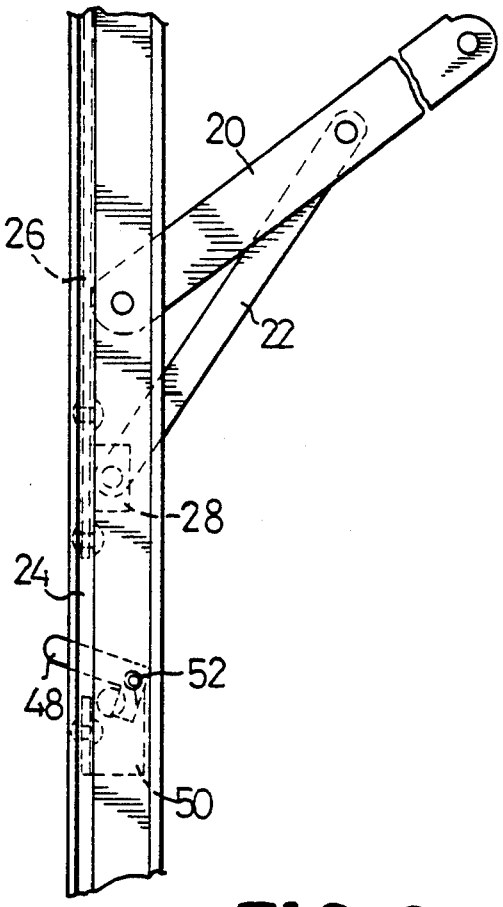
FIG. 6 is a view similar to FIG. 5, shown in the semi-folded position.

With general reference to FIGS. 1, 2, and 3 and with further, specific reference to FIGS. 4, 5, and 6, the bidirectional foldable step ladder is shown in a semi-folded position with respect to a width thereof. This is attained by drawing the first and the second side rails 10 and 12 respectively toward each other, which urges the steps 14 and the head step 16 to pivot upward at middle portions thereof. The bracing means 22 draw the plates 26 upward in the slots 24, best shown in FIGS. 5 and 6. This action is continued until corresponding side rails abut each other, after which the spreaders 18 are folded to draw the first side rails 10 toward the second side rails 12, which results in a totally folded position of the step ladder, as shown in FIG. 7.

Figure 7:
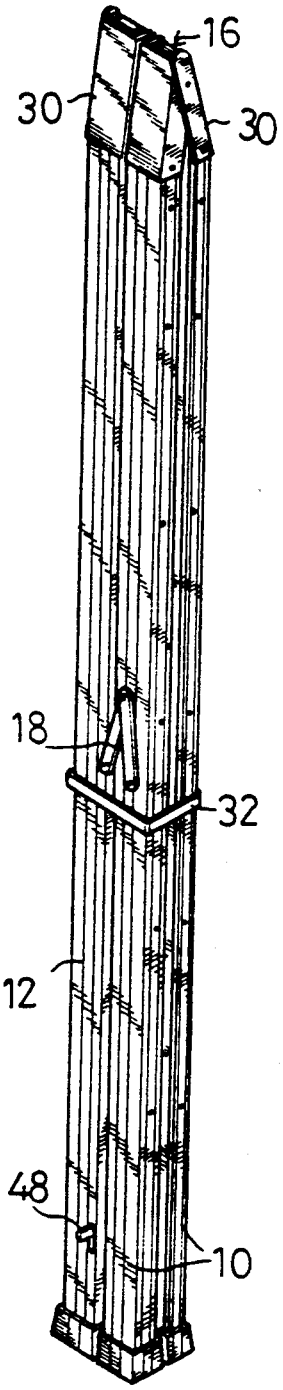
FIG. 7 is a view similar to FIG. 1, illustrating a folded position.

As can been seen from FIG. 7, the steps 14 and bracing means 22 are substantially contained within the side rails 10 and 12, resulting in streamlined storage. A retaining means such as a strap 32 may be employed to prevent the ladder from unfolding.

Figure 8:
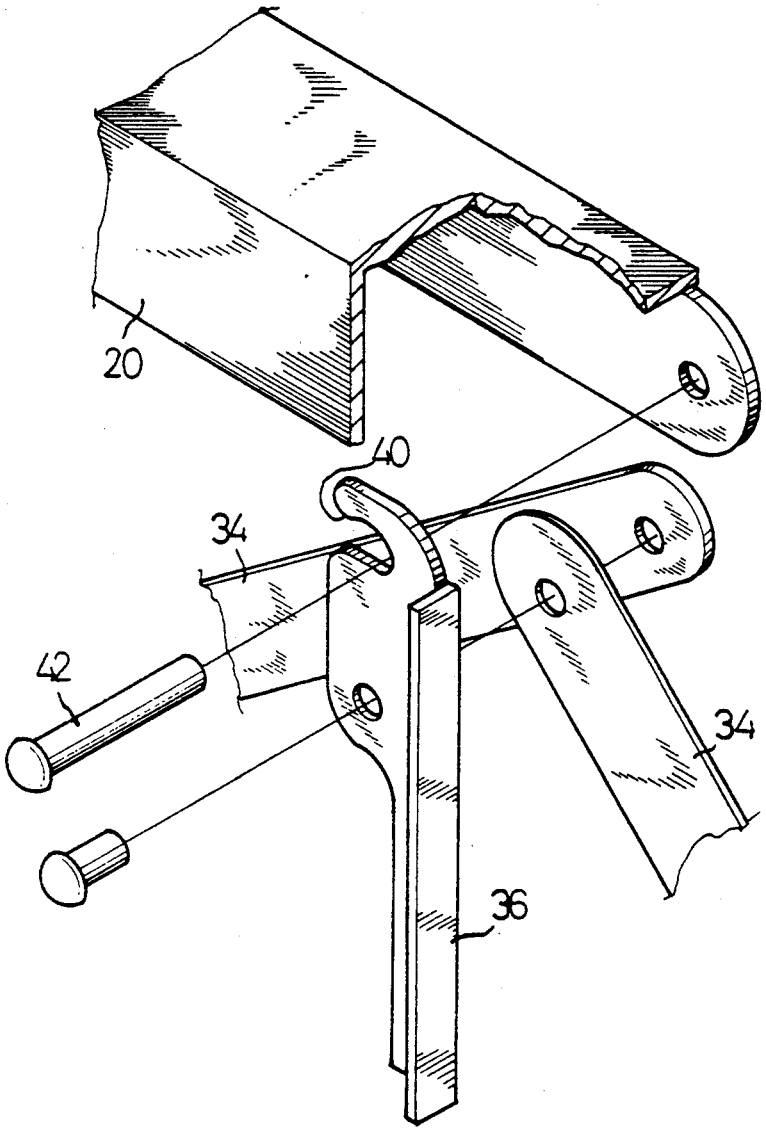
FIG. 8 is an exploded view of locking means of a bidirectionally foldable step ladder in accordance with the present invention.

The above description outlines a preferred embodiment in accordance with the present invention in a general manner. Generally referencing FIG. 1 and particularly referencing FIG. 8, a bidirectionally foldable step ladder in accordance with the present invention further comprises locking means for preventing the step ladder from folding with respect to the width thereof being disposed between the first or the second set of side rails 10 or 12 preferably below a lowermost step 14 and generally comprising a pair of plates 34 each being pivotally attached at one end thereof to a side rail 10 or 12 by suitable means such as rivets and a locking arm 36 being pivotally attached to the other ends of the plates 34 by suitable means such as a rivet. The locking arm 36 has a groove 40 formed in one end thereof and a handle portion formed on the other end thereof. A pin 42 is used as the suitable means of pivotal attachment for the two half steps 20 of the lowermost step 14.

Figure 9:
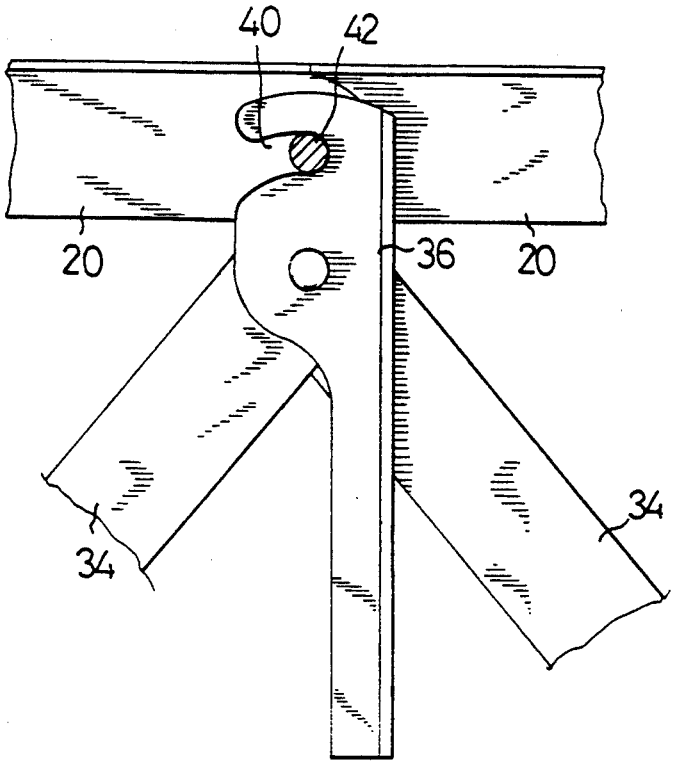
FIG. 9 is a side plan view of the locking means of FIG. 8, shown in a locked position.
Figure 10:
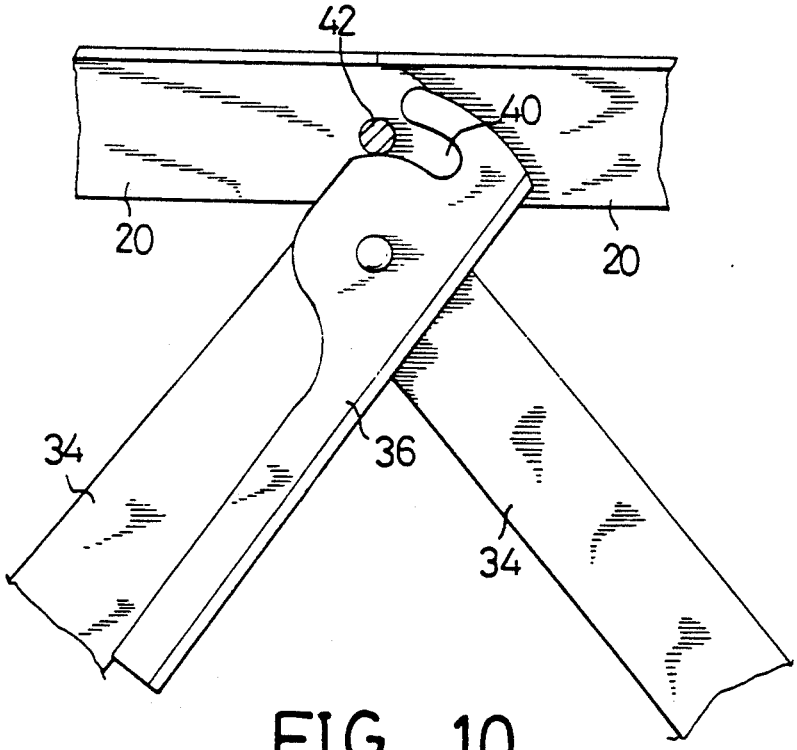
FIG. 10 is a view similar to FIG. 9, shown in an unlocked position.

With further reference to FIGS. 9 and 10, the pin 42 is receivable in the groove 40, thereby locking the step 14 in place. From this locked position, the lowermost step 14 is prevented from pivoting, thereby securing the step ladder in the position shown in FIG. 1. When it is desired to fold the step ladder with respect to the width thereof, the locking arm 36 is rotated with the handle portion thereof such that the pin 42 is no longer retained in the groove 40, as shown in FIG. 10. From this unlocked position, the lowermost step 14, as well as the remaining steps 14, is allowed to pivot.

With reference to FIGS. 1 and 2 and to FIGS. 5 and 6, a bidirectionally foldable step ladder in accordance with the present invention further comprises retaining means for retaining the step ladder in a folded position with respect to a depth thereof being disposed in opposing side rails and generally comprising a protuberance 46 having a conical end and an annular flange formed thereon and being fixed to a side rail by threading or the like, an L-shaped lever 48 being pivotally attached to an opposing side rail by suitable means such as a rivet, a guiding means 50 having a notch corresponding to the lever 48 and a hole corresponding to the protuberance formed therein and being fixed to the opposing side rail, and a spring 52 for urging the lever 48 in a specific direction. A slot corresponding to the lever 48 and a hole corresponding to the protuberance 46 are formed in the opposing rail.

As can be realized, when the spreaders 18 are folded and the step ladder is folded with respect to the depth thereof, the protuberance 46 passes through the holes of the opposing side rail and the guiding means 50, the conical end thereof urging the lever 48 in a counterclockwise direction against the force of the spring 52. When the annular flange of the protuberance 46 passes the lever 48, the spring 52 urges the lever 48 against the protuberance 46, thereby retaining the protuberance 46 in the guiding means 50 and preventing the step ladder from unfolding with respect to the depth thereof. When it is desired to unfold the step ladder, the lever 48 is urged in a counterclockwise direction, thereby freeing the protuberance 46 from the lever 48.

It should be noted from the above description that further variations of the presented preferred embodiment include a pair of locking means, which is shown in the figures, and a pair of retaining means, which isn't shown. Also worth noting is the substantial identicalness and symmetry of the elements; these characteristics of the present invention save on manufacturing costs, both on molding of the elements and assembly thereof.

Accordingly, it is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:,

1. A foldable step ladder comprising:

a first pair of side rails and a second pair of side rails, said pairs of side rails in opposition;

a first set of foldable steps and a second set of foldable steps being respectively disposed in spaced relationships between said first pair and said second pair of side rails, said steps being pivotally attached to said side rails by suitable means, said steps being foldable in a single direction;

a head step being pivotally attached to tops of said side rails by suitable means, being foldable in a same direction of said steps, and being foldable in a direction perpendicular to said direction of said steps; and a pair of foldable spreaders each being pivotally attached between said first and said second side rails by suitable means;

whereby said step ladder is foldable with respect to a width thereof by pivoting said steps and said head step, drawing said first pair of side rails together and drawing said second pair of side rails together, and is foldable with respect to a depth thereof by pivoting said spreaders and said head step, drawing said first pair and said second pair of side rails together.

2. A step ladder as claimed in claim 1, further comprising:

bracing means for supporting said steps and said head step being pivotally attached to each said step and to said head step by suitable means; and translation means being disposed in each said side rail for allowing said bracing means movement when said steps and said head step are being pivoted, said bracing means being pivotally attached to said translation means by suitable means.

3. A step ladder as claimed in claim 2, wherein:

each said side rail is substantially U-shaped; and said each said step comprises two half steps each having an upper stepping surface and a pair of lower parallel rails, said half steps being pivotally attached to each other at first ends thereof and to respective said side rails on an inside thereof;

whereby when said step ladder is folded with respect to said width thereof, said half steps are substantially contained within said side rails.

4. A step ladder as claimed in claim 3, wherein:

each said translation means comprises a longitudinal slot being formed in one said side rail, a plate being slidably received in said slot, and a plurality of brackets being fixed to said plate corresponding to said bracing means; and each said bracing means is pivotally attached to one said half step between said lower rails thereof and to one said bracket;

said plate being in a lowermost position in said slot such that further downward movement thereof is prevented which prevents said steps from pivoting below horizontal positions thereof.

5. A step ladder as claimed in claim 1, wherein said head step comprises:

a first set of quarter steps and a second step of quarter steps, said first and said second set of quarter steps being in opposition, each said quarter step having an upper stepping surface and a pair of lower parallel rails steps being respectively pivotally attached to said tops of said side rails, each said quarter step being pivotally attached to a corresponding said quarter step thereof at said lower rails thereof, said first set and said second set of quarter steps being pivotally attached to each other along top edges of common stepping surfaces thereof by suitable means.

6. A step ladder as claimed in claim 1, further comprising locking means for preventing said step ladder from folding with respect to said width thereof being disposed between said first set of side rails and between said second set of side rails below corresponding said steps.

7. A step ladder as claimed in claim 6, wherein each said locking means comprises a pair of plates each being pivotally attached at first end thereof to a corresponding said side rail by suitable means and a locking arm being pivotally attached to second ends of said plates by suitable means;

said locking arm having a groove formed in one end thereof and a handle portion formed on the other end thereof; a pin being used as said suitable means of pivotal attachment for said half steps of said corresponding step and being receivable in said groove;

whereby when said locking arm is in a first position, said pin is received in said groove, thereby preventing said corresponding step from pivoting, and when it is desired to fold said step ladder with respect to said width thereof, said locking arm is rotated with said handle portion thereof to a second position, such that said pin is no longer retained in said groove, thereby allowing said corresponding step to pivot.

8. A step ladder as claimed in claim 1, further comprising retaining means for retaining said step ladder in a folded position with respect to a depth thereof being disposed in opposing said side rails.

9. A step ladder as claimed in claim 8, wherein said retaining means comprises:

a protuberance having a conical end and an annular flange formed thereon and being fixed to one said side rail, an L-shaped lever being pivotally attached to an opposing said side rail, a guiding means having a notch corresponding to said lever and a hole corresponding to said protuberance formed therein and being fixed to said opposing side rail, and a spring for urging said lever in a specific direction;

a slot corresponding to said lever and a hole corresponding to said protuberance being formed in said opposing side rail;

whereby when said spreaders are folded and said step ladder is folded with respect to said depth thereof, said protuberance passes through said holes of said opposing side rail and said guiding means, said conical end thereof urging said lever in a first direction against a force of said spring; when said annular flange of said protuberance passes said lever, said spring urges said lever against said protuberance, thereby retaining said protuberance in said guiding means and preventing said step ladder from unfolding with respect to said depth thereof; and when it is desired to unfold said step ladder, said lever is urged in said first direction, thereby freeing said protuberance from said lever.

10. A step ladder as claimed in claim 1, wherein said side rails are substantially identical and said steps are substantially identical.

* * * * *